US010352556B2

(12) United States Patent
Sedmak

(10) Patent No.: US 10,352,556 B2
(45) Date of Patent: Jul. 16, 2019

(54) METHOD AND BURNER FOR REDUCING NITROGEN OXIDE EMISSIONS DURING THE COMBUSTION OF A GASEOUS FUEL

(71) Applicant: FIVES STEIN, Maisons Alfort (FR)

(72) Inventor: Patrice Sedmak, Laimont (FR)

(73) Assignee: FIVES STEIN, Maisons Alfort (FR)

( * ) Notice: Subject to any disclaimer, the term of this patent is extended or adjusted under 35 U.S.C. 154(b) by 290 days.

(21) Appl. No.: 15/104,779

(22) PCT Filed: Dec. 16, 2014

(86) PCT No.: PCT/IB2014/066971

§ 371 (c)(1),
(2) Date: Jun. 15, 2016

(87) PCT Pub. No.: WO2015/092682

PCT Pub. Date: Jun. 25, 2015

(65) Prior Publication Data

US 2017/0003018 A1 Jan. 5, 2017

(30) Foreign Application Priority Data

Dec. 17, 2013 (FR) ..... 13 62792

(51) Int. Cl.
*F23C 9/08* (2006.01)
*F23C 5/08* (2006.01)
(Continued)

(52) U.S. Cl.
CPC ..... *F23C 9/08* (2013.01); *F23C 3/002* (2013.01); *F23C 5/08* (2013.01); *F23C 9/006* (2013.01);
(Continued)

(58) Field of Classification Search
CPC .... F23C 9/08; F23C 5/08; F23C 3/002; F23C 9/006; F23C 2202/20; F23C 2202/30; F23C 2900/09002; F23D 2203/1012
(Continued)

(56) References Cited

U.S. PATENT DOCUMENTS 2,882,843 A 4/1959 Everett
4,917,599 A * 4/1990 Hasselmann ..... F23D 14/82 431/326

(Continued)

OTHER PUBLICATIONS

International Search Report, dated Mar. 24, 2015, from corresponding PCT Application.

*Primary Examiner* — Avinash A Savani
*Assistant Examiner* — Rabeeul I Zuberi
(74) *Attorney, Agent, or Firm* — Young & Thompson

(57) ABSTRACT

A method for reducing nitrogen oxide NOx emissions during combustion of a gaseous fuel in a burner intended for a naked-flame or controlled-atmosphere reheating furnace, for reheating steel products or for continuous coating and/or annealing of metal strips, wherein a first dilution is carried out by mixing combustion air with combustion products upstream from or in the body of the burner, and a second dilution is carried out directly at the level at which the gaseous fuel reacts with the combustion air, mixing the fuel with a recirculated portion of the flame or products of partial combustion, the double dilution enabling the physical and chemical properties of the gas to be modified in order for the burner to operate with low oxygen rates and obtain a flame that produces a very low level of NOx production regardless of the temperature of the enclosure in which the combustion takes place.

17 Claims, 2 Drawing Sheets

(51) Int. Cl.
*F23C 3/00* (2006.01)
*F23C 9/00* (2006.01)

(52) U.S. Cl.
CPC ..... *F23C 2202/20* (2013.01); *F23C 2202/30* (2013.01); *F23C 2900/09002* (2013.01); *F23D 2203/005* (2013.01); *F23D 2203/1012* (2013.01)

(58) Field of Classification Search
USPC ..... 431/326, 328, 115, 116
See application file for complete search history.

(56) References Cited

U.S. PATENT DOCUMENTS

| | | | | |
|---|---|---|---|---|
| 5,350,293 | A * | 9/1994 | Khinkis | F23C 6/045 431/116 |
| 6,027,330 | A | 2/2000 | Lifshits | |
| 6,464,492 | B1 * | 10/2002 | Guarco | F23C 9/08 110/345 |
| 6,663,380 | B2 * | 12/2003 | Rabovitser | F23C 6/04 431/116 |
| 2004/0002030 | A1 * | 1/2004 | Shah | F23L 7/007 431/12 |

* cited by examiner

METHOD AND BURNER FOR REDUCING NITROGEN OXIDE EMISSIONS DURING THE COMBUSTION OF A GASEOUS FUEL

The invention applies mainly to radiant tube burners intended for controlled-atmosphere reheating furnaces, for example for the continuous coating and/or annealing of metal strips or the direct flame heating of products, for example steel products.

The invention makes it possible to obtain particularly low levels of nitrogen oxides NOx by the use of two successive recirculation stages while retaining a good energy efficiency, whatever the temperature level of the chamber in which the combustion takes place.

The burners for reheating furnaces, for example steel industry furnaces have been modified repeatedly in order to comply with successive regulations or standards regarding the emission of pollutants, in particular nitrogen oxides NOx.

A large number of burners according to the prior art use dilution in order to reduce the level of NOx emitted, the combustion air or the flame being diluted by combustion products in order to develop this flame in a larger volume, therefore reducing its average temperature and thus limiting the NOx produced.

Dilution provides a satisfactory solution to the reduction of NOx. However, there is a limit to this dilution due to the inflammability limit of the mixture and the of the flame instability. The proposed invention provides a solution to these problems of inflammability and of flame stability for large dilution values, which makes it possible to achieve particularly low values of NOx emitted by the furnaces which are equipped with burners of this type.

The prior art for radiant tubes is presented by way of example in FIG. 1. A radiant tube 1 is installed in the chamber of a furnace 2 equipped with side walls 4, a tubular recuperator plug in a recuperator body 5 or in a leg 12*b* of the radiant tube and a burner 10 installed in the leg 12*a* of the radiant tube. The flue gases 3 from the combustion pass through the radiant tube up to the outlet, on the recuperator side, where a portion 8 of these flue gases is sent to the furnace exhaust, for example a chimney (not represented), and a portion 9 of the flue gases is channeled to the burner 10 in order to be mixed therein with the combustion air 7 preheated in the recuperator 6. The preheated combustion air 7 is mixed firstly with the flue gases 9 then with the gas from the pipe 11 in order to produce a flame in the leg of the radiant tube 12*a*. It is also possible to consider all the solutions that make it possible to channel a portion of the flue gases before or after the energy recovery devices such as 6 in order to dilute them with the combustion air 7 either before entering the burner 10, for example by mixing the feed flows 7 and 9 upstream of the burner 10, or directly at the nozzle of the burner in the zone where the combustion of the fuel 11 with the oxidant 7 takes place.

This dilution of the combustion air with the flue gases makes it possible to increase the volume in which the combustion develops, to control the oxygen content in the reaction zone, and then to reduce the temperature of said combustion, which reduces the NOx emitted by this combustion.

Equipment is known according to the prior art where this dilution of the volume in which the combustion takes place is achieved directly by the jets of fuel and of oxidant injected into the volume of the chamber where the combustion occurs, which induce this recirculation of combustion products thus mixed with the reactive gases. FIG. 2 presents this type of equipment where the burner 15 produces a flame 13 which generates a recirculation of the combustion gases present in the chamber along the paths 14 and 16 in order to dilute the flame by increasing its volume and thus reducing the average flame temperature which has the result of reducing the production of thermal NOx.

According to the prior art, the volumes of flue gases recirculated in the fuel and oxidant reaction zone according to the principles disclosed by FIGS. 1 and 2 may range, for example, from 20% of the volume of oxidant (generally air) to 100%, or even more than 100%. It is understood that this recirculation significantly increases the volume of the reactive zone, which reduces its average temperature and thus the level of NOx emitted.

It is understood that the dilution of the combustion air reduces the percentage of oxygen in the reaction zone of the fuel with the oxidant, which generates flame ignition and instability problems. There is a recirculation limit beyond which it is difficult to ignite the burner, at high or low temperature, and to produce a stable and controlled flame, the combustion cannot be self-sustaining and the flame goes out due to lack of oxygen.

This limit of inflammability of the mixture and of flame stability, which depends on the percentage of oxygen in the oxidant and on the temperature of the chamber of the furnace, currently forms an obstacle for the reduction of NOx by means of this dilution technology.

In order to solve this ignition and instability problem, according to prior art, it is often proposed to start the burner in a mode that does not implement the dilution and in which the percentage of oxygen in the reaction zone and the temperature are sufficient to produce a stable flame. This mode may be obtained for example by supplying the burner with reduced fuel and/or oxidant pressures relative to the normal operation thereof. Under these conditions, the level of NOx is very high. When the chamber reaches a sufficient temperature, for example above the self-ignition temperature, a combustion mode with a high dilution may be established, for example by increasing the air and/or gas feed pressures favorable to obtaining a reduced NOx level. For low furnace temperatures, for example close to the self-ignition temperature of the fuel, moving to a combustion mode with high dilution is not automatic and the burner may continue to operate according to its mode without dilution, that is to say to operate while producing a lot of NOx which is contrary to what it is desired to obtain.

The invention proposes to provide a solution to this problem while allowing rates of dilution of the combustion air by a large amount of flue gases with in order to obtain a very low emission rate of pollutants, in particular NOx, at all the operating mode of the furnace and at all the operating temperatures of the furnace, including the low temperatures below or equal to the self-ignition temperature of the fuel, without being detrimental to the stability of the flame.

According to the invention, a process is proposed for reducing the emission of nitrogen oxides NOx during the combustion of a gaseous fuel in a burner intended for an direct flame or controlled-atmosphere reheating furnace, for reheating steel products or for continuous coating and/or annealing of metal strips, according to which process a first dilution is achieved by mixing combustion air with combustion products upstream of the burner or in the body of the burner, characterized in that a second dilution is achieved by mixing the gaseous fuel with a recirculated portion of the flame or partial combustion products, this second dilution having an input of thermal energy at the meeting point of the gaseous fuel with the recirculated portion of the flame or the partial combustion products, this double dilution resulting in the modification of the physical and chemical characteristics of the gaseous fuel for a stable operation of the burner.

Preferably, the process for reducing the emission of nitrogen oxides NOx during the combustion of a gaseous fuel in a burner intended for an direct flame or controlled-atmosphere reheating furnace, for reheating steel products or for continuous coating and/or annealing of metal strips, especially steel strips, according to which process a first dilution is achieved by mixing combustion air with combustion products upstream of the burner or in the body of the burner, is characterized in that a second dilution is achieved by mixing the fuel with a recirculated portion of the flame or the partial combustion products, this double dilution resulting in the modification of the physical and chemical properties of the gas for a stable operation of the burner, in particular with a highly diluted oxidant having an oxygen content close to 10% by volume, for the purpose of reducing the production of NOx, for example for a natural gas up to values close to 100 mg/Nm$^3$ @ 3% $O_2$, this being for all the operating temperatures of the chamber in which the combustion takes place.

Preferably, the second dilution is achieved by injecting at least two gaseous fuel jets that are substantially parallel, at a distance from one another and suitable for inducing a vacuum in a zone located between the jets, which leads to a circulation of partial combustion products in this zone, and ensures the mixing of the gaseous fuel with a recirculated portion of the flame or the partial combustion products.

Preferably, the gaseous fuel jets are distributed along a closed contour, in particular in a ring, and the vacuum zone is located on the inside of the closed contour, in particular of the ring, leading to a circulation of the partial combustion products in this zone. The gaseous fuel jets may be distributed in a circular ring, the diameter of which is between 80 and 120 mm.

Advantageously, the initial velocity of the gaseous fuel jets is at least equal to 120 m/sec for a natural gas in order to provide a flame recirculation sufficient for obtaining a stable flame.

The mixture of combustion air and of combustion products, in particular flue gases, may be distributed in an annular zone surrounding the gaseous fuel jets.

Advantageously, the second dilution is achieved at the nozzle of the burner by recirculation of products resulting from the reactive zone of the flame, in particular with free radicals, used for initiating thermochemical reactions in the fuel.

The oxygen content of the mixture of combustion air with combustion products, resulting from the first dilution, may be less than 15% by volume, in particular close to 10%.

The invention also relates to a gaseous fuel burner intended for an direct flame or controlled-atmosphere reheating furnace, for reheating steel products or for continuous coating and/or annealing of metal strips, characterized in that it is designed to achieve a double dilution, a first dilution being obtained by mixing combustion air with combustion products achieved upstream of the burner or in the body of the burner, the second dilution being obtained by mixing of the gaseous fuel with a recirculated portion of the flame or the partial combustion products, this second dilution having an input of thermal energy at the meeting point of the gaseous fuel with the recirculated portion of the flame or the partial combustion products, this double dilution resulting in the modification of the physical and chemical characteristics of the gaseous fuel to enable a stable operation of the burner.

Preferably, the gaseous fuel burner intended for an direct flame or controlled-atmosphere reheating furnace, for reheating steel products or for continuous coating and/or annealing of metal strips, especially steel strips, is characterized in that it is designed to achieve a double dilution, a first dilution being obtained by mixing the combustion air with combustion products achieved upstream of the burner or in the body of the burner, the second dilution being obtained by mixing of the fuel with a recirculated portion of the flame, this double dilution resulting in the modification of the physical and chemical characteristics of the gas to enable the stable operation of the burner, in particular with a highly diluted oxidant having an oxygen content close to 10% by volume, for the purpose of reducing the production of NOx, this being for all the operating temperatures of the chamber in which the combustion takes place.

Advantageously, the burner comprises, to achieve the second dilution, at least two orifices for injection of gaseous fuel jets that are substantially parallel, at a distance from one another and suitable for inducing a vacuum in a zone located between the jets.

For radiant tube applications, the burner may be positioned in a pipe for the mixture of combustion air and combustion products, in particular flue gases, which is distributed in an annular zone surrounding the portion of the burner equipped with orifices for the gaseous fuel jets.

The burner may comprise a burner nozzle composed of a cylindrical portion attached to which, perpendicular to the geometric axis of the cylindrical portion and set back from the opening plane of the cylindrical portion, is a disk pierced with a plurality of orifices, the axes of which are substantially parallel to the axis of the cylindrical portion, that are located over a diameter close to the external diameter of the disk, and a tube having a diameter smaller than that of the cylindrical portion is attached coaxial to this portion, one of its ends being located inside said portion while leaving a distance between this end and the front face of the disk, the other end of the tube being located outside of the cylindrical portion.

The burner may be designed so that the mixture of combustion air and flue gases is distributed around the cylindrical portion, and the gas jets from the ring of orifices induce a vacuum inside the tube which enables a return of flame to the burner. The vacuum makes it possible to suck back up products at flame root in order to mix them with the fuel.

The fuel inlet may comprise a tubular portion of small diameter, for example of DN 20 for a natural gas, followed by a cone coupled to the cylindrical portion.

The burner may comprise a stack of tubes and of a ring of holes in a distribution plate in order to produce a suction zone in the location of start up of the oxidation of the fuel by the oxidant.

The invention consists, apart from the arrangements disclosed above, of a certain number of other arrangements that will be mentioned more explicitly hereinbelow with respect to an exemplary embodiment described with reference to the appended drawings, but which is in no way limiting. In these drawings.

Figure 1:
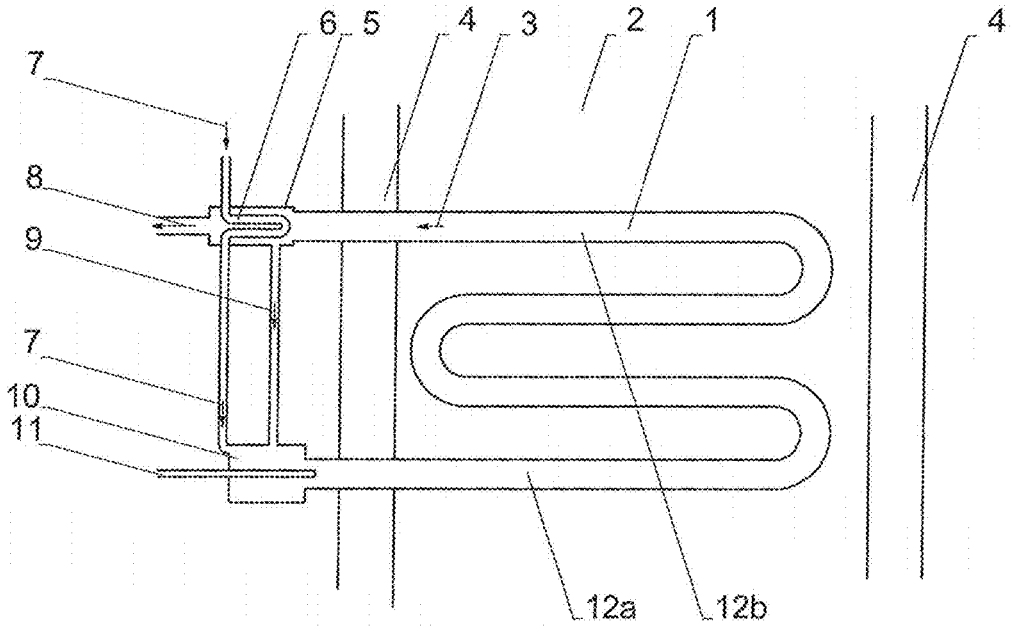
FIG. 1 is a schematic drawing of a radiant tube with burner according to the prior art.
Figure 3:
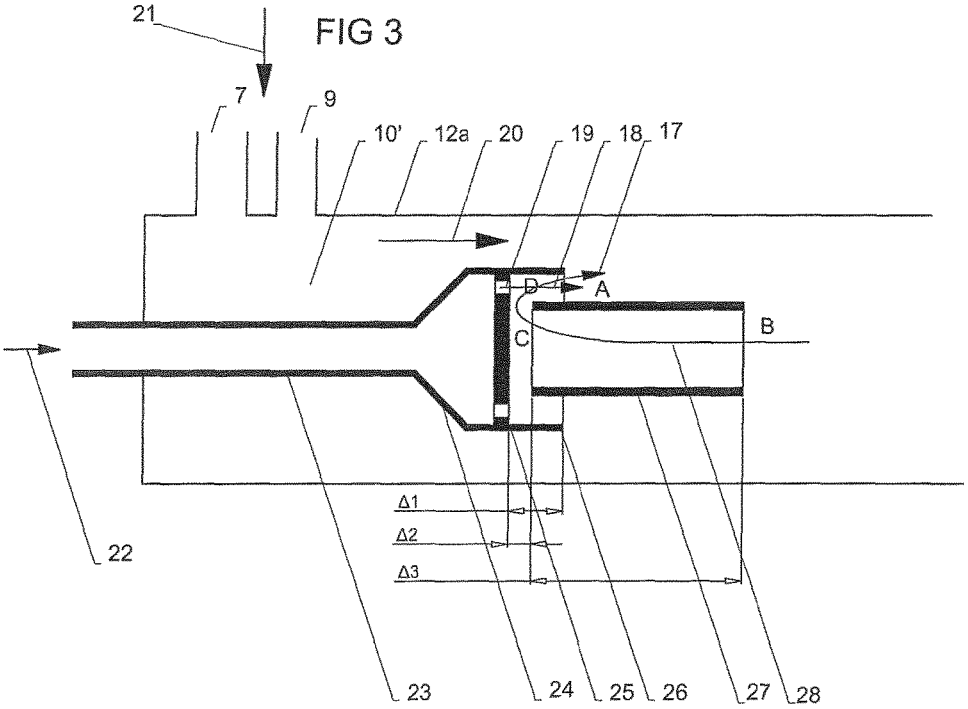
FIG. 3 is a schematic drawing of vertical cross section of a burner according to the invention.

The solution of the invention is illustrated in FIG. 3 which schematically presents the burner 10' and the first leg of the radiant tube 12*a,* as shown in FIG. 1.

Seen in FIG. 3 is the port 21 corresponding to the inlet of recirculated flue gases such as 9 and of combustion air 7 preheated in a recuperator, not represented in FIG. 3, but similar to the recuperator 6 from FIG. 1. The same result may be obtained with an inlet of a pre-established mixture of recirculated flue gases 9 and of combustion air 7.

The fuel inlet 22 is composed of a tubular portion 23, for example of diameter DN 20 for a natural gas, a cone 24, followed by a cylindrical portion 26. Inside the cylindrical portion 26 a disk 25 is attached orthogonal to the geometric axis of the portion 26, in particular welded to the inside of said tube, so that there is a distance Δ1, for example of between 30 and 60 mm for the natural gas, between the front face of this disk and the opening plane of the tube 26. The disk 25 is pierced with a plurality of orifices 19, for injection of fuel, the axes of which are substantially parallel to the axis of the tube 26, that are located over a diameter, in particular of 10 mm, smaller than the external diameter of the disk.

A tube 27 is welded in the axis of the tube 26, one of its ends being located inside the tube 26 while leaving a distance Δ2, in particular of between 5 and 30 mm for a natural gas, between this end and the front face of the disk 25. The tube 27 extends over a distance Δ3, in particular of between 100 and 250 mm, beyond the end of the tube 26.

The mixture of combustion air and flue gases is distributed, in the pipe 12*a,* along an annular zone 20, around the cylinder 26 and gas jets 18 from the ring of orifices 19. The injections 18 of gas at high velocity, greater than 120 m/sec of natural gas, induce a vacuum in the tube 27, which leads to a suction of the combustion products along the path 28 illustrated in the tube 27 from the zone B, located in the vicinity of the end of the tube 27 far from the disk 25, to a zone C located between the end of the tube 27 close to the disk 25 and the disk.

The zone B is in the reaction zone of the fuel and of the oxidant, that is to say in a very high temperature flame zone, in particular above 1500 K and in a zone where the development of the combustion produces a large amount of partially oxidized and reactive chemical species including free radicals present in a plasma-type state of these combustion products. It may also be noted that, contrary to what occurs when a recirculation of flue gases is implemented conventionally, for which the increase in the recirculation degrades the stability of the flame, the implementation of the dilution of the fuel at the burner nozzle as presented by the invention in the presence of an oxidant having a low oxygen content, in particular 10% by volume, extends the stability range of the flame. The energy provided by this recirculation 28 of very high temperature gas at the meeting point D with the fuel modifies its physicochemical characteristics, in particular partially achieves the partial thermal cracking of the fuel which ensures the development of the combustion in the zone A, around the tube 27. This is obtained despite the low concentration of oxygen present in the mixture of flue gases and air 20. By this means, it is possible to achieve the ignition and stabilization of the reaction zone even with very low oxygen contents via a local supply of thermal energy and the modification of the thermochemical properties of the fuel, which makes it possible to extend the inflammability limits of the air/fuel gas mixture, in particular at an oxygen content of 10% by volume.

The reactions involved may be, for example, of the type:

$$CH_4+H_2O=3H_2+CO$$

$$CH_4\rightarrow C+2H_2$$

$$CO+H_2O=CO_2+H_2$$

From these equations, the formation of hydrogen may be noted, which will promote the ignition of the fuel despite a low concentration of oxygen.

This device makes it possible to maintain a stable flame with oxygen contents lower than those used according to the prior art and thus to obtain levels of NOx produced that are lower than those obtained according to the prior art, this whatever the temperature of the chamber in which the combustion develops.

It may also be noted that the implementation of the recirculation of the combustion products at the burner nozzle as presented by the invention in the presence of a mixture of air and flue gases having a low oxygen content, in particular 10% by volume, increases the stability of the flame by facilitating the combustion, or the ignition of the fuel.

It is seen that the operation of this burner is based on a double dilution, the first dilution achieved by the mixing of the combustion air with combustion products upstream of the reaction zone, the second dilution achieved directly in the reaction zone by the dilution of the fuel with the reactants of the high-temperature flame directly at the burner nozzle. This second "dilution" is different since it does not have the simple effect of diluting the gases, but also, due to the input of thermal energy greater than the self-ignition temperature, it contributes to the modification of the thermochemical properties of the fuel gas via complex phenomena that can be likened to a pyrolysis. The mixture of fuel gas and of incomplete combustion products reacts in order to produce in particular hydrogen, resulting in a modification of the thermochemical properties of the gas.

Figure 2:
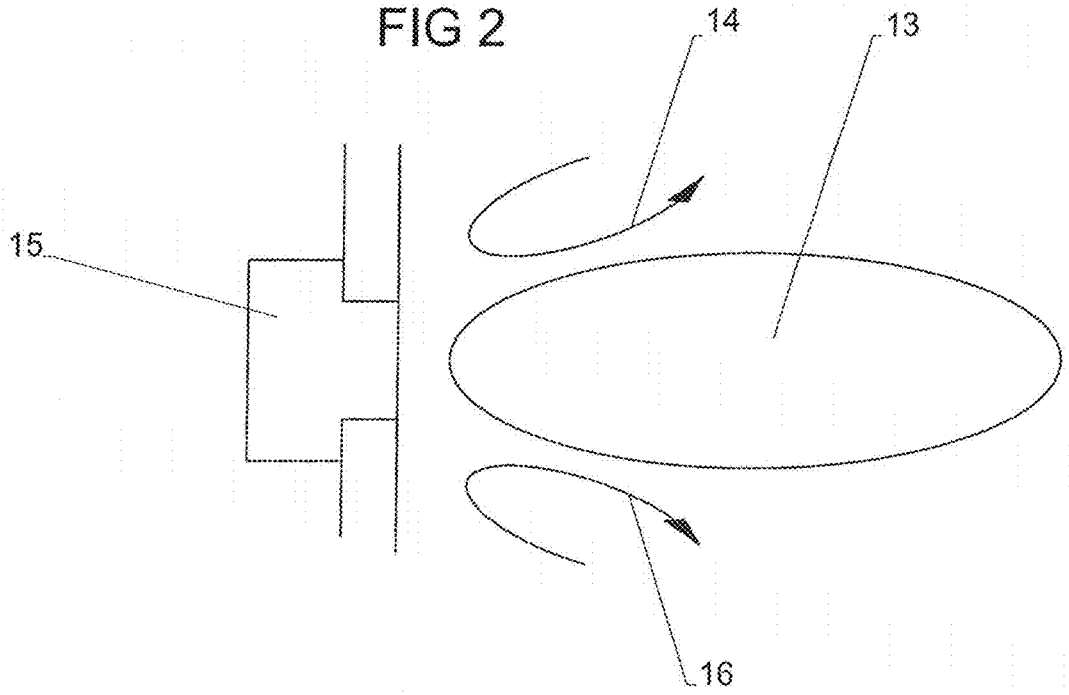
FIG. 2 is a schematic drawing of equipment with burner according to the prior art.

It is understood that the preceding description of the invention was given for an application to a radiant tube but that the disclosed arrangements can be transposed to direct flame burners for which the first dilution is achieved y the mixing of combustion products inside the furnace, along the paths 14 and 16 from FIG. 2, and that the second dilution may be achieved at the burner nozzle with a device as presented in FIG. 3.

The invention claimed is:

1. A process for reducing the emission of nitrogen oxides NOx during the combustion of a gaseous fuel in a burner intended for a direct flame or controlled-atmosphere reheating furnace, for reheating steel products or for continuous coating and/or annealing of metal strips, especially steel strips, according to which process, a first dilution is achieved by mixing combustion air with combustion products upstream of the burner or in the body of the burner, wherein the combustion air mixed in the first dilution is all the combustion air used in the process, a second dilution is achieved by mixing the gaseous fuel with a recirculated portion of the flame or the partial combustion products, wherein the gaseous fuel in the second dilution is un-diluted and un-premixed before the second dilution, this double dilution resulting in the modification of the physical and chemical characteristics of the gas for a stable operation of the burner, in particular with a highly diluted oxidant having an oxygen content close to 10% by volume, for the purpose of reducing the production of NOx, this being for all the operating temperatures of the chamber in which the combustion takes place, wherein the second dilution is achieved at the burner nozzle by recirculation of products resulting from the reactive zone of the flame, in particular with free radicals, used for initiating thermochemical reactions in the fuel.

2. The process as claimed in claim 1, wherein the second dilution is achieved by injecting at least two gaseous fuel jets that are substantially parallel, at a distance from one another and suitable for inducing a vacuum in a zone located between the jets, which leads to a circulation of partial combustion products in this zone, and ensures the mixing of the gaseous fuel with a recirculated portion of the flame or the partial combustion products.

3. The process as claimed in claim 2, wherein the gaseous fuel jets are distributed along a closed contour, in particular in a ring, and the vacuum zone is located on the inside of the closed contour, in particular of the ring, leading to a circulation of the partial combustion products in this zone.

4. The process as claimed in claim 2, wherein the gaseous fuel jets are distributed in a circular ring, the diameter of which is between 80 and 120 mm.

5. The process as claimed in claim 1, wherein the initial velocity of the gaseous fuel jets is at least equal to 120 m/second for natural gas.

6. The process as claimed in claim 1, wherein the mixture of combustion air and of combustion products, in particular flue gases, is distributed in an annular zone surrounding the gaseous fuel jets.

7. The process as claimed in claim 1, wherein the oxygen content of the mixture of combustion air with combustion products, resulting from the first dilution, is less than 15% by volume, in particular close to 10% by volume.

8. A gaseous fuel burner intended for a direct flame or controlled-atmosphere reheating furnace, for reheating steel products or for continuous coating and/or annealing of metal strips, especially steel strips, wherein the burner is designed to achieve a double dilution, a first dilution is achieved by mixing combustion air with combustion products upstream of the burner or in the body of the burner, wherein the combustion air mixed in the first dilution is all the combustion air used in the process, the second dilution is achieved by mixing the gaseous fuel with a recirculated portion of the flame or the partial combustion products, wherein the gaseous fuel in the second dilution is un-diluted and un-premixed before the second dilution, this double dilution resulting in the modification of the physical and chemical characteristics of the gas to enable a stable operation of the burner, in particular with a highly diluted oxidant having an oxygen content close to 10% by volume, for the purpose of reducing the production of NOx, this being for all the operating temperatures of the chamber in which the combustion takes place, the burner comprising a burner nozzle composed of a cylindrical portion attached to which, perpendicular to the geometric axis of the cylindrical portion and set back from the opening plane of the cylindrical portion, is a disk pierced with a plurality of orifices, the axes of which are substantially parallel to the axis of the cylindrical portion, that are located over a diameter close to the external diameter of the disk, and a tube having a diameter smaller than that of the cylindrical portion is attached coaxial to this portion, one of its ends being located inside said portion while leaving a distance between this end and the front face of the disk, the other end of the tube being located outside of the cylindrical portion.

9. The burner as claimed in claim 8, wherein to achieve the second dilution, the burner further comprises at least two ports for injection of gaseous fuel jets that are substantially parallel, at a distance from one another and suitable for inducing a vacuum in a zone located between the jets.

10. The burner as claimed in claim 9, wherein the ports for injection of gaseous fuel are distributed along a closed contour, in particular in a ring.

11. The burner as claimed in claim 8, wherein the burner is positioned in a pipe for the mixture of combustion air and combustion products, in particular flue gases, which is distributed in an annular zone surrounding the portion of the burner equipped with ports for the gaseous fuel jets.

12. The burner as claimed in claim 8, wherein the mixture of combustion air and flue gases is distributed around the cylindrical portion (26), and the gas jets (18) from the ring of orifices (19) induce a vacuum inside the tube (27), which enables a return of flame to the burner.

13. The burner as claimed in claim 8, wherein the fuel inlet (22) comprises a tubular portion of small diameter (23), followed by a cone (24) coupled to the cylindrical portion (26).

14. The burner as claimed in claim 8, further comprising a stack of tubes (25, 26) and of a ring of holes (19) in a distribution plate (25) in order to produce a suction zone (A) in the location of start up for the oxidation of the fuel by the oxidant.

15. The burner as claimed in claim 9, wherein the burner is positioned in a pipe for the mixture of combustion air and combustion products, in particular flue gases, which is distributed in an annular zone surrounding the portion of the burner equipped with ports for the gaseous fuel jets.

16. The burner as claimed in claim 12, wherein the fuel inlet (22) comprises a tubular portion of small diameter (23), followed by a cone (24) coupled to the cylindrical portion (26).

17. The burner as claimed in claim 12, further comprising a stack of tubes (25, 26) and of a ring of holes (19) in a distribution plate (25) in order to produce a suction zone (A) in the location of start up for the oxidation of the fuel by the oxidant.

* * * * *